US011489260B2

(12) United States Patent
Contal

(10) Patent No.: US 11,489,260 B2
(45) Date of Patent: Nov. 1, 2022

(54) RADIOFREQUENCY TRANSMISSION DEVICE COMPRISING A FASTENING ELEMENT FORMING A RADIATING PORTION OF AN ANTENNA

(71) Applicant: SAGEMCOM BROADBAND SAS, Rueil Malmaison (FR)

(72) Inventor: Serge Contal, Rueil Malmaison (FR)

(73) Assignee: SAGEMCOM BROADBAND SAS, Rueil Malmaison (FR)

( * ) Notice: Subject to any disclaimer, the term of this patent is extended or adjusted under 35 U.S.C. 154(b) by 0 days.

(21) Appl. No.: 17/255,567

(22) PCT Filed: Jun. 19, 2019

(86) PCT No.: PCT/EP2019/066307
§ 371 (c)(1),
(2) Date: Dec. 23, 2020

(87) PCT Pub. No.: WO2020/002114
PCT Pub. Date: Jan. 2, 2020

(65) Prior Publication Data

US 2021/0288407 A1 Sep. 16, 2021

(30) Foreign Application Priority Data

Jun. 27, 2018 (FR) ..... 1855790

(51) Int. Cl.

| | |
|---|---|
| ***H01Q 9/04*** | (2006.01) |
| ***H01Q 19/10*** | (2006.01) |
| ***H01Q 19/32*** | (2006.01) |
| ***H01Q 1/24*** | (2006.01) |

(52) U.S. Cl.
CPC ..... *H01Q 9/0421* (2013.01); *H01Q 1/24* (2013.01); *H01Q 9/04* (2013.01); *H01Q 19/10* (2013.01); *H01Q 19/32* (2013.01)

(58) Field of Classification Search
CPC ..... H01Q 9/0421; H01Q 1/24; H01Q 19/10; H01Q 19/32; H01Q 9/04; H01Q 9/30; H01Q 9/28
USPC ..... 343/834
See application file for complete search history.

(56) References Cited

U.S. PATENT DOCUMENTS

| | | | | |
|---|---|---|---|---|
| 4,028,709 A * | 6/1977 | Berkowitz | ..... | H01Q 1/1228 343/819 |
| 2008/0198082 A1* | 8/2008 | Soler Castany | ..... | H01Q 13/10 343/770 |
| 2009/0033568 A1* | 2/2009 | Hung | ..... | H01Q 1/243 343/702 |

(Continued)

FOREIGN PATENT DOCUMENTS

CN 101499554 A 8/2009

*Primary Examiner* — Hai V Tran
(74) *Attorney, Agent, or Firm* — Muncy, Geissler, Olds & Lowe, P.C.

(57) ABSTRACT

The invention relates to a radiofrequency transmission device comprising an electrical board, a transmission line, and an electroconductive fastening element which is intended to fasten the electrical board to a support, the transmission line being electrically coupled to the fastening element such that the fastening element forms at least one first radiating portion of an antenna arranged so as to emit and/or receive radiofrequency signals travelling along the transmission line.

13 Claims, 9 Drawing Sheets

(56) References Cited

U.S. PATENT DOCUMENTS

2013/0271327 A1* 10/2013 Oohara ..... H01Q 1/24
343/702
2018/0062241 A1* 3/2018 Lester ..... H01Q 1/44

* cited by examiner

RADIOFREQUENCY TRANSMISSION DEVICE COMPRISING A FASTENING ELEMENT FORMING A RADIATING PORTION OF AN ANTENNA

The invention relates to the field of radiofrequency (RF) transmit/receive devices including a fastener element forming a radiating portion of an antenna.

BACKGROUND OF THE INVENTION

Antennas are used in an extremely large number of a wide variety of applications, in all industrial fields: automotive, aviation, telecommunications, medicine, energy, etc.

In general, an antenna is fastened on a support of some kind by one or more metal fastener elements: screws, clips, staple, etc.

Thus, a whip antenna, e.g. an antenna mounted on a car, is screw-fastened by means of a screw or a thread situated at one end of the whip antenna.

Likewise, in a certain number of mobile telephones, there are one or more antennas, each in the form of a metal component fastened by screws on a support, e.g. on a printed circuit or on a housing of the telephone.

Metal fastener elements for antennas, and also other metal fastener elements, e.g. those used for fastening an electric circuit card to a housing, tend to hinder the operation of antennas situated in the proximity of said metal fastener elements.

Furthermore, in general, an antenna incorporated in or on a piece of electrical equipment occupies a relatively large volume of the electrical equipment. It is thus very advantageous to seek to reduce the volume occupied by the antenna.

OBJECT OF THE INVENTION

An object of the invention is to improve the RF communication performance achieved by a piece of electrical equipment in or on which there is incorporated an antenna, and to reduce the volume occupied by the antenna.

SUMMARY OF THE INVENTION

In order to achieve this object, there is provided an RF transmit/receive device comprising a circuit card, a transmission line, and an electrically conductive fastener element for fastening the circuit card on a support, the transmission line being electrically coupled with the fastener element so that the fastener element forms at least a first radiating portion of an antenna arranged to transmit and/or to receive RF signals conveyed along the transmission line. The circuit card further comprises a first antenna track connected to the transmission line and electrically coupled with the fastener element, the first antenna track forming a second radiating portion of the antenna.

Thus, in the RF transmit/receive device of the invention, the fastener element forms a first radiating portion of the antenna and is thus used to transmit and/or to receive RF signals. The fastener element is thus no longer an element that disturbs RE communication. On the contrary, advantage is taken of the dimensions of the fastener element in order to form the antenna. This thus reduces the volume inside the electrical equipment in which the RF transmit/receive device of the invention is incorporated that is dedicated to the antenna, thereby reducing the volume of the electrical equipment itself.

There is also provided an RF transmit/receive device as described above, wherein the circuit card includes a first surface formed on a conductive layer and a second surface formed on an insulating layer, the first surface being a ground surface, the fastener element extending from or through the second surface.

There is also provided an RF transmit/receive device as described above, wherein the transmission line is a transmission-line track of the circuit card that extends from within the first surface to the second surface in order to form the first antenna track that extends within the second surface to the proximity of the fastener element.

There is also provided an RF transmit/receive device as described above, wherein the circuit card includes a second antenna track that extends within the second surface, that is connected to the first antenna track, and that forms a third radiating portion of the antenna.

There is also provided an RF transmit/receive device as described above, wherein the resonant frequency of the antenna is also defined on the basis of a length of the first antenna track and/or of a length of the second antenna track, and thus of at least one dimension of the second surface.

There is also provided electrical equipment including an RF transmit/receive device as described above.

The invention can be better understood in the light of the following description of particular, nonlimiting embodiments of the invention.

BRIEF DESCRIPTION OF THE DRAWINGS

Reference is made to the accompanying drawings, in which.

DETAILED DESCRIPTION OF THE INVENTION

Figure 1:
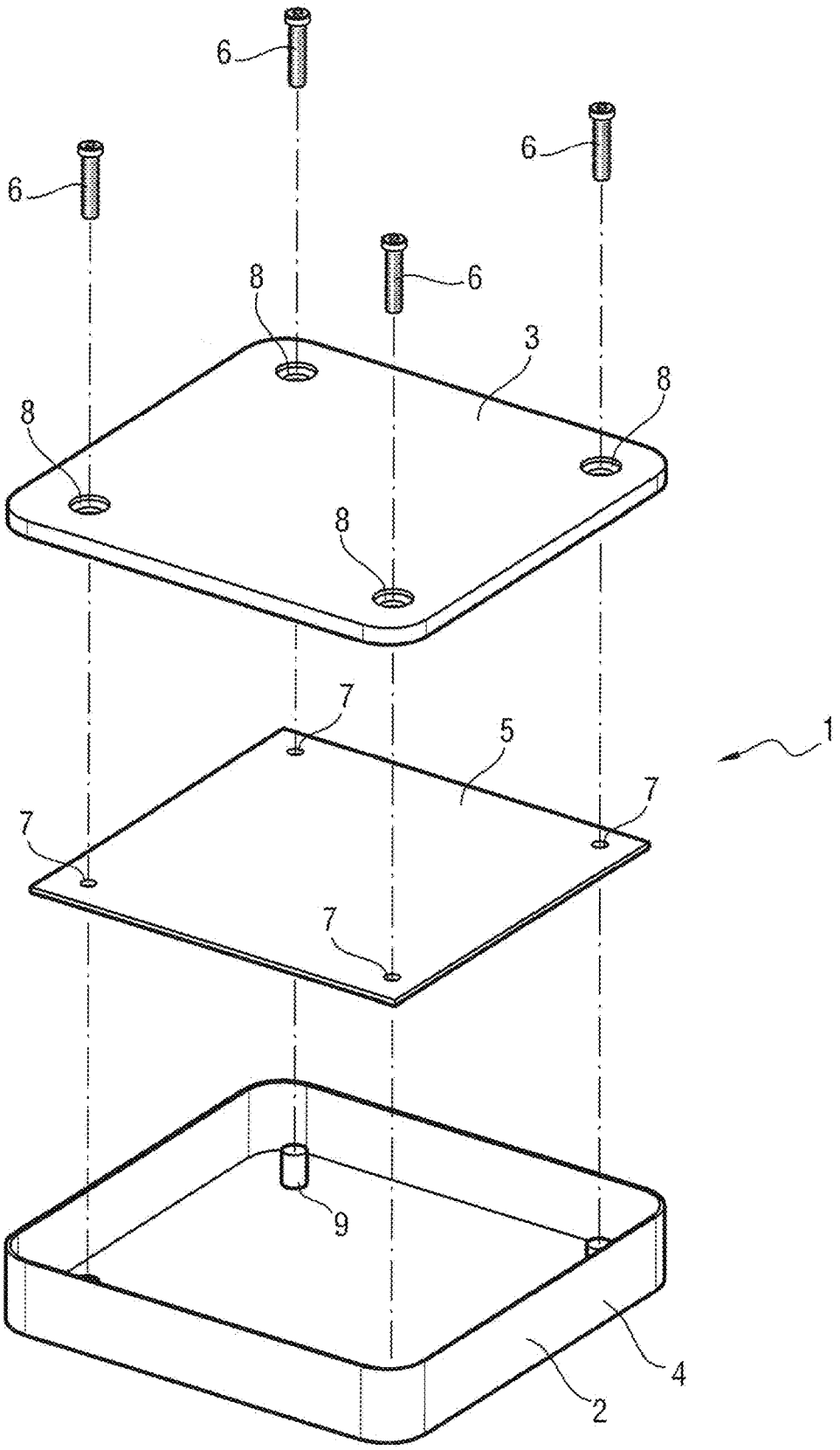
FIG. 1 is an exploded perspective view of electrical equipment incorporating an RF transmit/receive device in a first embodiment of the invention.
Figure 2:
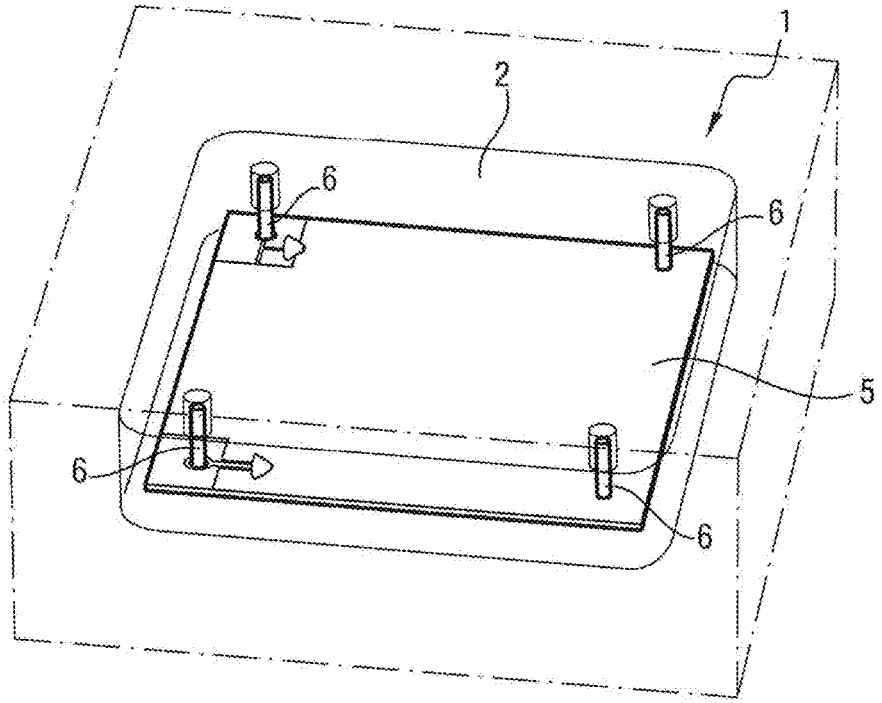
FIG. 2 is a transparent perspective view of the electrical equipment.

With reference to FIGS. 1 and 2, an RF transmit/receive device in a first embodiment of the invention is incorporated in this example in a piece of electrical equipment 1 that includes a housing 2 in addition to the RF transmit/receive device. In this example, the housing 2 is made of plastics material, specifically acrylonitrile butadiene styrene (ABS). The housing 2 comprises a top cover 3 and a bottom cover 4.

The RF transmit/receive device firstly comprises a circuit card 5. The circuit card 5 is fastened to the housing 2 by four screws 6. The housing 2 is thus a support for the circuit card 5. The circuit card 5 has four holes 7, each positioned in a respective corner of the circuit card 5. Likewise, the top cover 3 has four holes 8, each positioned in a respective corner of the top cover 3. In contrast, the bottom cover 4 has four tapped studs 9, each positioned in a respective corner of the bottom cover 4. Thus, in order to fasten the circuit card 5 to the housing 2 and in order to close the housing 2, each screw 6 extends through a hole 8 made in the top cover 3, a hole 7 made in the circuit card 5, and is screwed into a tapped stud 9 of the bottom cover 4.

In this example, each screw 6 is made of iron and presents a diameter of 3 millimeters (mm) and a length of about 18 mm.

Figure 3:
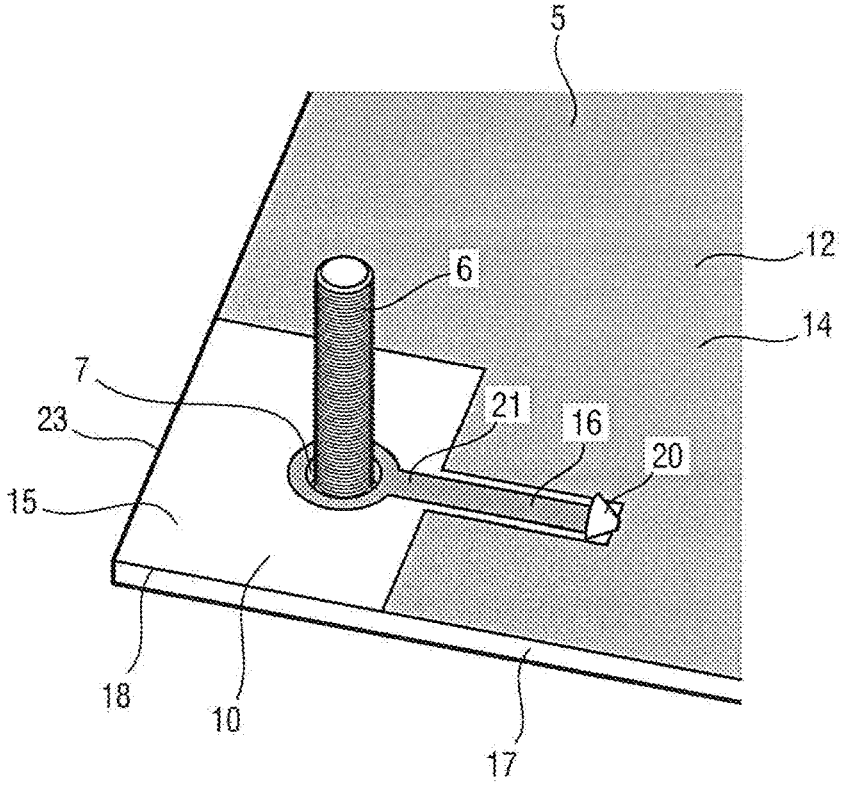
FIG. 3 is a perspective view from above of a circuit card and of a screw of the RF transmit/receive device in the first embodiment of the invention.
Figure 4:
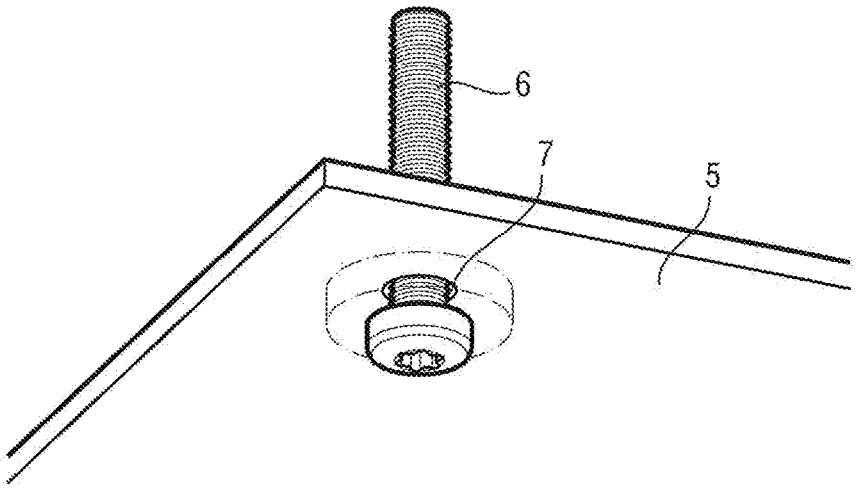
FIG. 4 is a view similar to FIG. 3, but from below.

With reference to FIGS. 3 and 4, the circuit card 5 comprises an insulating layer 10 having a conductive layer 12 bonded thereon.

By way of example, the substrate that is used is an FR4 substrate having a dielectric constant $\varepsilon_r$=4.2 and a thickness of 1 mm.

A first surface 14 is formed on the conductive layer 12. The first surface 14 is a ground surface that covers a large fraction of the insulating layer 10 with the exception, in particular, of a rectangular portion of the insulating layer 10.

This rectangular portion defines a rectangular second surface 15 formed on the insulating layer 10.

The RF transmit/receive device also includes a transmission line 16, which in this example is specifically a transmission-line track 16 formed on the conductive layer 12 of the circuit card 5.

The transmission-line track 16 extends within the first surface 14, parallel to an edge 17 of the circuit card 5 and to a first side 18 of the second surface 15.

A transmission-line port 20 is positioned in the first surface 14 at a first end of the transmission-line track 16. At its second end, the transmission-line track 16 leads into the second surface 15 and it forms a first antenna track 21 in the second surface 15. The transmission-line track 16 and the first antenna track 21 are connected together and they are thus constituted by a single track, but they differ in that the transmission-line track 16 extends within the ground surface, whereas the first antenna track 21 extends on the insulating layer 10 without being surrounded by ground.

The RF transmit/receive device further includes a screw 6 that extends from or through the second surface 15, and in this example it extends through the second surface 15.

One of the holes 7 in the circuit card 5 and through which the screw 6 extends is positioned in the second surface 15. The hole 7 is a metal-lined hole 7. In this example, the metal-lined hole 7 is a plated through hole presenting an inside surface that is plated in metal. It would be possible for the hole 7 to be metal-lined in some other way, e.g. by inserting a metal tube in the hole 7.

The first antenna track 21 extends into the second surface 15 up to the proximity of the metal-lined hole 7, and it is electrically coupled to the metal-lined hole 7. In this example, the first antenna track 21 extends around the metal-lined hole 7 and it is directly connected to the metal-lined hole 7.

The screw 6 is thus positioned in the immediate proximity of the metal-lined hole 7, or indeed it is in contact with the metal-lined hole 7, such that the transmission-line track 16 is electrically coupled with the screw 6 via the metal-lined hole 7 and the first antenna track 21.

The transmission-line track 16 thus forms a transmission line 16 for conveying RF signals, while the screw 6 forms a first radiating portion of an antenna and the first antenna track 21 forms a second radiating portion of the antenna. The screw 6 and the first antenna track 21 thus form an antenna to which the transmission-line track 16 is connected.

The term "radiating portion" is used to mean the portion that contributes actively to the radiation produced by the antenna and presents characteristics that contribute to defining the intrinsic electromagnetic characteristics of the antenna.

The RF signals conveyed by the transmission-line track 16 are generated by a transmitter component of the circuit card 5, they are applied to the transmission-line track 16 via the transmission-line port 20 of the transmission-line track 16, and they are then radiated by the antenna, and/or they are received by the antenna and applied to a receiver component of the circuit card 5 via the transmission-line port 20. The antenna can thus clearly be used for transmitting and/or receiving RF signals.

The transmission line 16 that is formed by the transmission-line track 16 and that is connected to the antenna, has a characteristic impedance of 50 ohms (Ω) (unlike the first antenna track 21 that forms a second radiating portion of the antenna and not a line connected to the antenna).

The active portion of the antenna thus begins at the end of the first antenna track 21 that corresponds to the second end of the transmission-line track 16.

It should be observed that the screw 6 does not need to be strictly in contact with the first antenna track 21. The electric coupling provided by the proximity between the body of the screw 6 and the metal-plated inside surface of the metal-lined hole 7 through the thickness of the printed circuit of the circuit card 5 suffices to propagate RF signals between the first antenna track 21 and the screw 6. Nevertheless, even though non-repeatable contact (e.g. contact depending on manufacturing or positioning tolerances) might very well have no significant influence on the performance of the antenna, it can be advantageous to provide a device that ensures very good repeatability. By way of example, the device may include a mechanical index.

The antenna constituted by the first antenna track 21 and by the screw 6 is a monopole antenna, and in this example it presents a resonant frequency of 5.25 gigahertz (GHz).

The resonant frequency of the antenna is defined by the length of the screw 6 and by the length of the first antenna track 21, and thus by at least one dimension of the second surface 15, specifically the length of the first side 18 of the second surface 15.

Thus, starting with a screw 6 of a given length, equal to 18 mm in this example, the length of the first antenna track 21 and thus of the first side 18 of the second surface 15 is adjusted in order to define the resonant frequency desired for the antenna. Adjusting the length of the first antenna track 21 amounts to adjusting the length of the first side 18 of the second surface 15, since it is assumed herein that the screw 6 is positioned at a distance from the edge 23 of the circuit card 5 that is constant (i.e. not adjustable).

Figure 5:
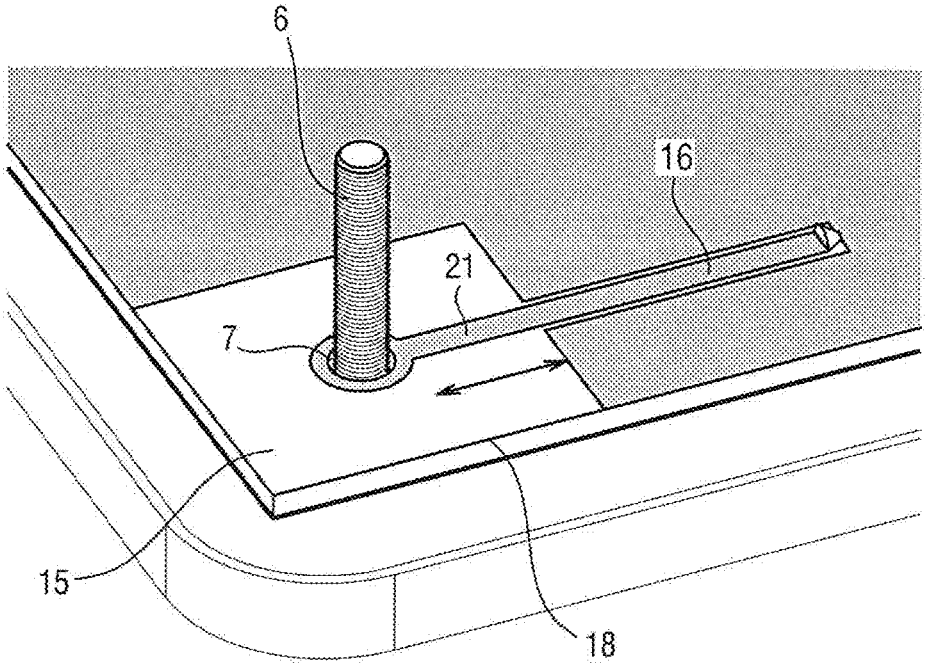
FIGS. 5 and 6 are views similar to FIG. 3, but with different lengths for a first antenna track.

With reference to FIG. 5, the length of the first antenna track 21, and thus the length of the first side 18 of the second surface 15, can be relatively long.

Figure 6:
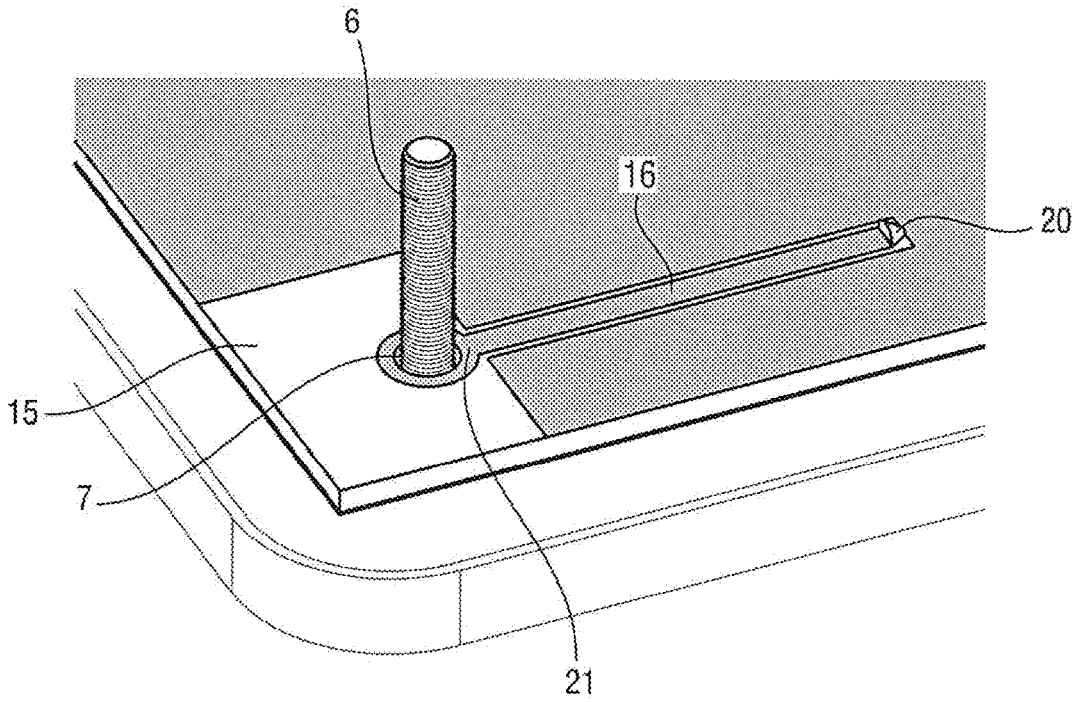
Figure 7:
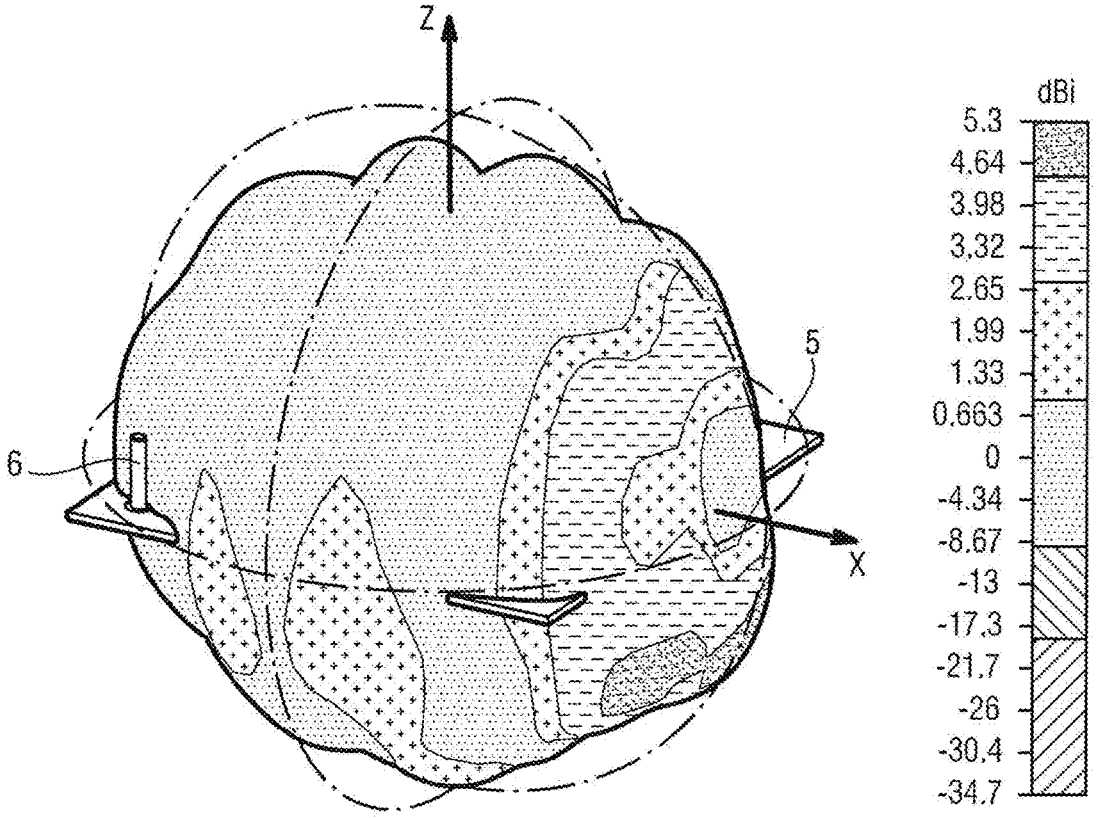
FIG. 7 shows a three-dimensional radiation pattern for an antenna of the RF transmit/receive device in the first embodiment of the invention.
Figure 8:
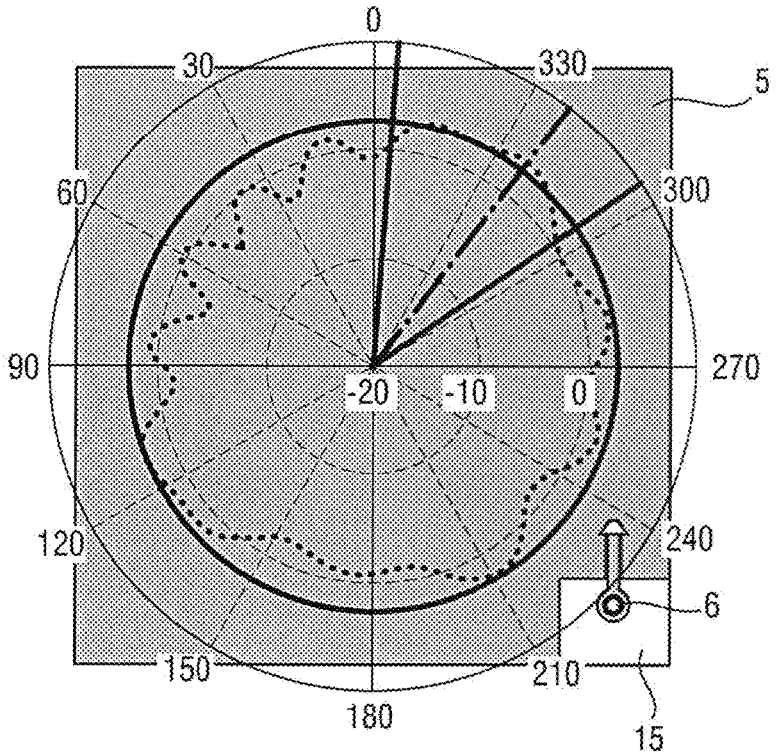
FIG. 8 is a section of the FIG. 7 radiation pattern, with an angle Theta having a fixed value equal to 90°.
Figure 9:
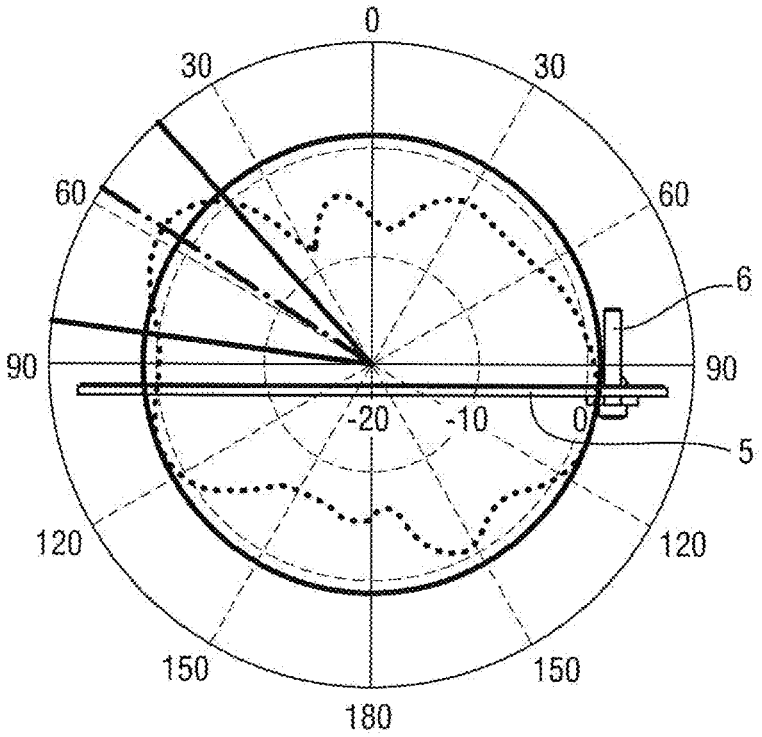
FIG. 9 is a section of the FIG. 7 radiation pattern, with an angle Phi having a fixed value equal to 90°.
Figure 10:
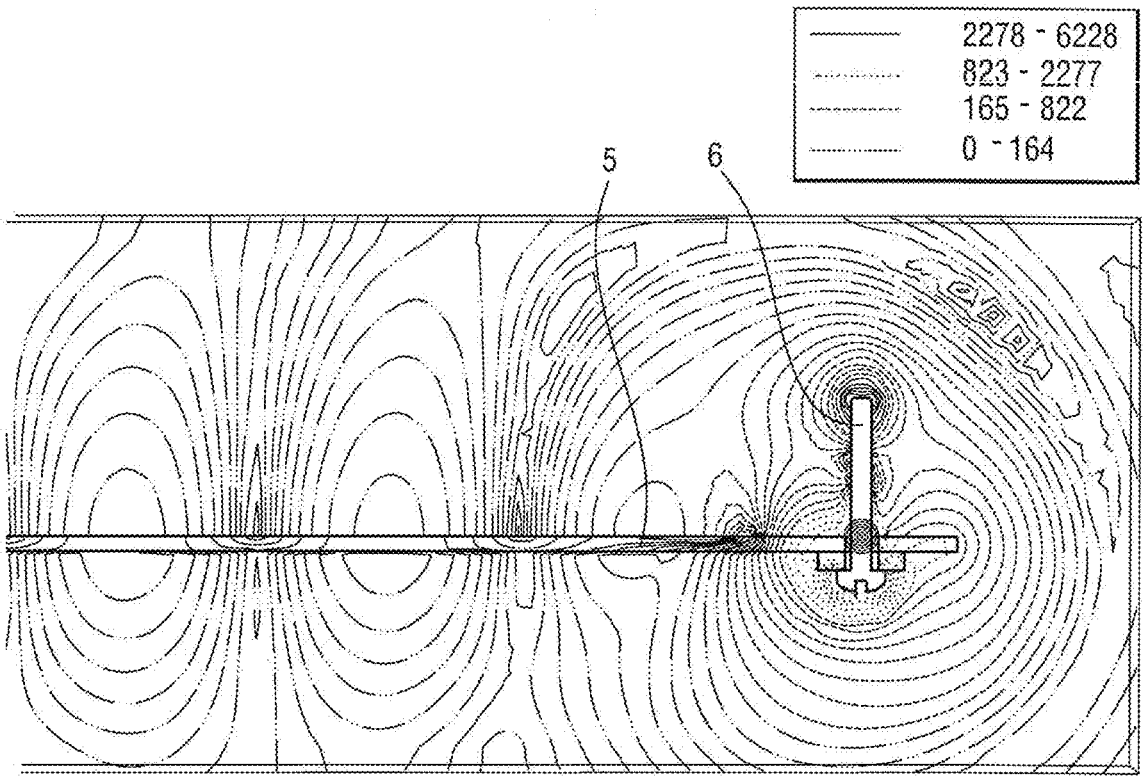
FIG. 10 represents the electric field around the screw.

With reference to FIG. 6, the length of the first antenna track 21 could also be very short, or indeed almost zero, such that the first antenna track 21 is formed solely by the portion surrounding the metal-lined hole 7 and by the metal-lined hole 7 itself.

In this example, the starting point is thus a screw 6 of given length, and the resonant frequency of the antenna is defined by adjusting the length of the first antenna track 21 and thus of the first side 18 of the second surface 15. It would also be possible to start with a given circuit card 5 and to define the resonant frequency by selecting the length of the screw 6 so that the length of the first antenna track 21 and the length of the screw 6 serve to obtain the looked-for resonant frequency.

It should be observed that using the length of the screw 6 to define the resonant frequency of the antenna makes it possible to reduce the area of the circuit card 5 that is dedicated to the antenna, and thus the space inside the housing 2 that is dedicated to the antenna.

It should also be observed that using the screw 6 makes it possible to obtain great diversity in the electromagnetic polarization of the antenna, even in a housing 2 of small volume. Specifically, unlike conventional applications in which pieces of electrical equipment of small thickness have antennas that are flat, the screw 6 of the transmit/receive device in the first embodiment of the invention extends perpendicularly to the circuit card 5 in this example. A three-dimensional antenna is thus obtained without increasing the volume of the piece of electrical equipment 1, by making use of a screw 6 that is necessary in any event for fastening the circuit card 5 and for closing the housing 2.

With reference to FIGS. 7 to 10, it can be seen that for the antenna made up of the screw 6 and the first antenna track 21, the effectiveness obtained at a frequency of 5.25 GHz is about −0.72 decibels (dB), i.e. lying in the range 70% to 80%.

Figure 11:
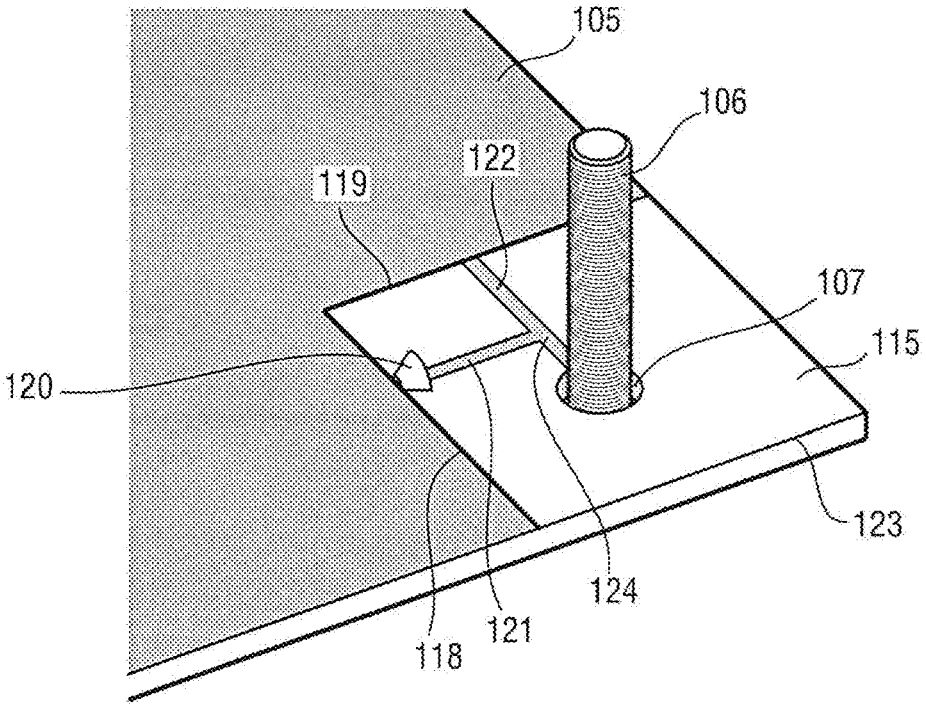
FIGS. 11 to 13 are perspective views from above of a circuit card and a screw of an RF transmit/receive device in a second embodiment of the invention, the views differing from one another in the length of a second antenna track.
Figure 12:
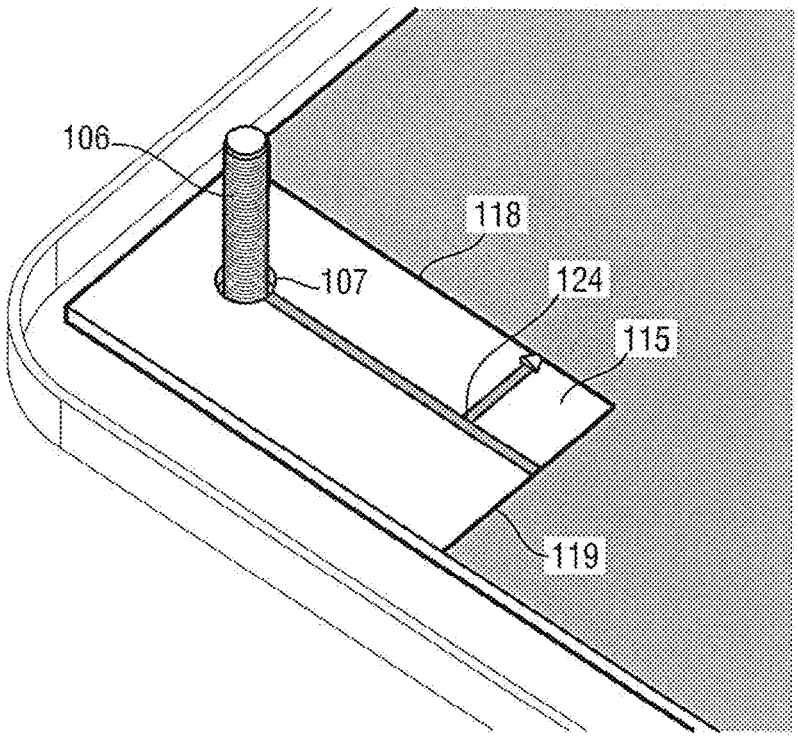
Figure 13:
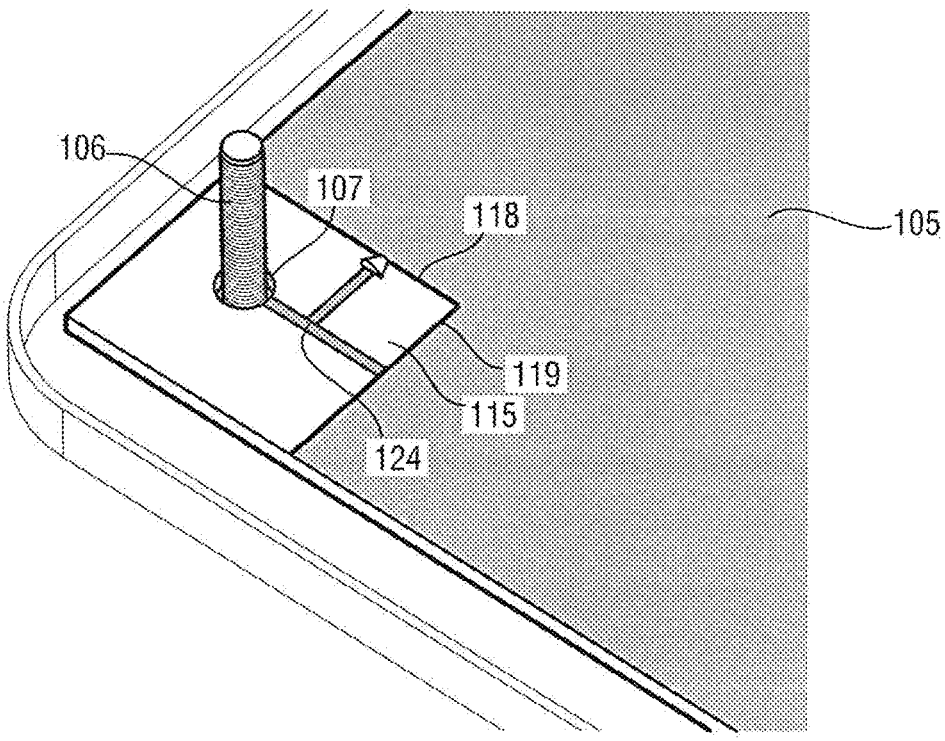

With reference to FIGS. 11 to 13, a circuit card 105 of an RF transmit/receive device in a second embodiment of the invention comprises, in this example, a first antenna track 121 and a second antenna track 122 both lying in the second surface 115, together with a transmission-line track (not shown). The circuit card 105 also has a metal-lined hole 107 positioned in the second surface 115.

The RF transmit/receive device in the second embodiment of the invention also includes a screw 106 that extends through the metal-lined hole 107.

The screw 106 forms a first radiating portion of the antenna of the RF transmit/receive device in the second embodiment of the invention, while the first antenna track 121 forms a second radiating portion of the antenna, and the second antenna track 122 forms a third radiating portion of the antenna.

The first antenna track 121 extends from a first side 118 of the second surface 115. The first antenna track 121 is connected to the transmission-line track via a transmission-line port 120 positioned at a first end of the first antenna track 121 that is situated on the first side 118.

The second antenna track 122 extends from a second side 119 of the second surface 115 that is perpendicular to the first side 118. The second antenna track 122 is connected to the metal-lined hole 107.

The first antenna track 121 and the second antenna track 122 are perpendicular and they are connected together at a connection point 124 that is situated on the second antenna track 122 and that corresponds to the second end of the first antenna track 121.

The resonant frequency of the antenna is defined by the length of the screw 106 and by the length of the second antenna track 122, and thus by the length of at least one dimension of the second surface 115, specifically the length of the first side 118 of the second surface 115. Specifically, in this example, the screw 106 is still positioned at a constant distance from the edge 123 of the circuit card 105.

It is specified that the resonant frequency of the antenna could perfectly well be defined as a function of the length of the first antenna track 121 (and/or of the length of the second antenna track 122).

In this example, the antenna is a planar inverted-F antenna (PIFA). The radiating whip comprises the second antenna track 122 and the screw 106.

In FIGS. 11 to 13, it can be seen that the connection point 124 is always situated at much the same distance from the second side 119, such that the resonant frequency of the antenna is defined more precisely by the distance along the second antenna line 122 between the connection point 124 and the metal-lined hole 107.

Figure 14:
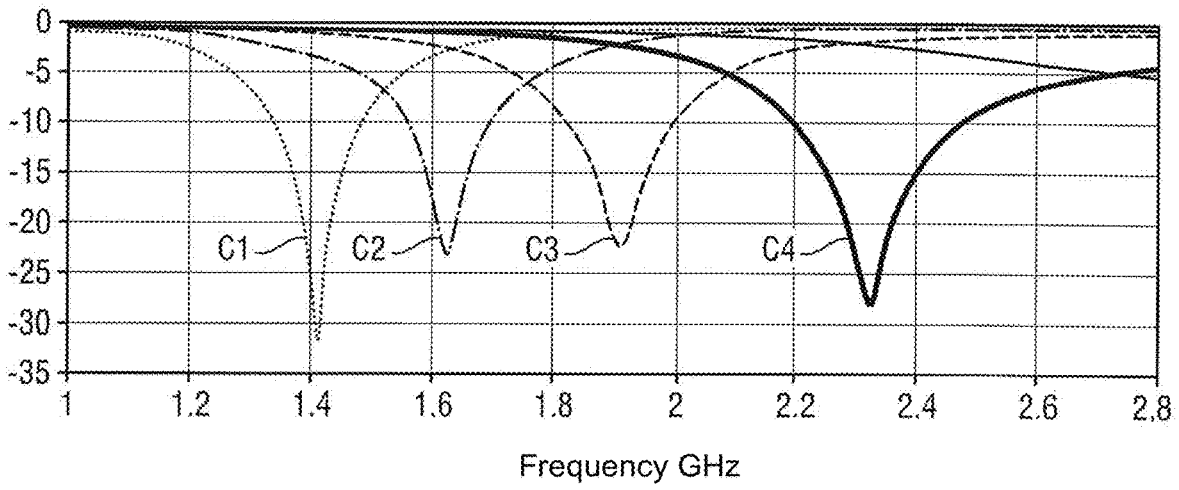
FIG. 14 is a graph plotting curves of the S11 parameter for different lengths of the second antenna track.

With reference to FIG. 14, it can clearly be seen that the resonant frequency, which corresponds to a minimum of a curve for the S11 parameter, depends on the length of the second antenna track 122. The curve C1 corresponds to the second antenna track 122 having a length equal to 8 mm. The curve C2 corresponds to the second antenna track 122 having a length equal to 12 mm. The curve C3 corresponds to the second antenna track 122 having a length equal to 16 mm. The curve C4 corresponds to the second antenna track 122 having a length equal to 20 mm.

Figure 15:
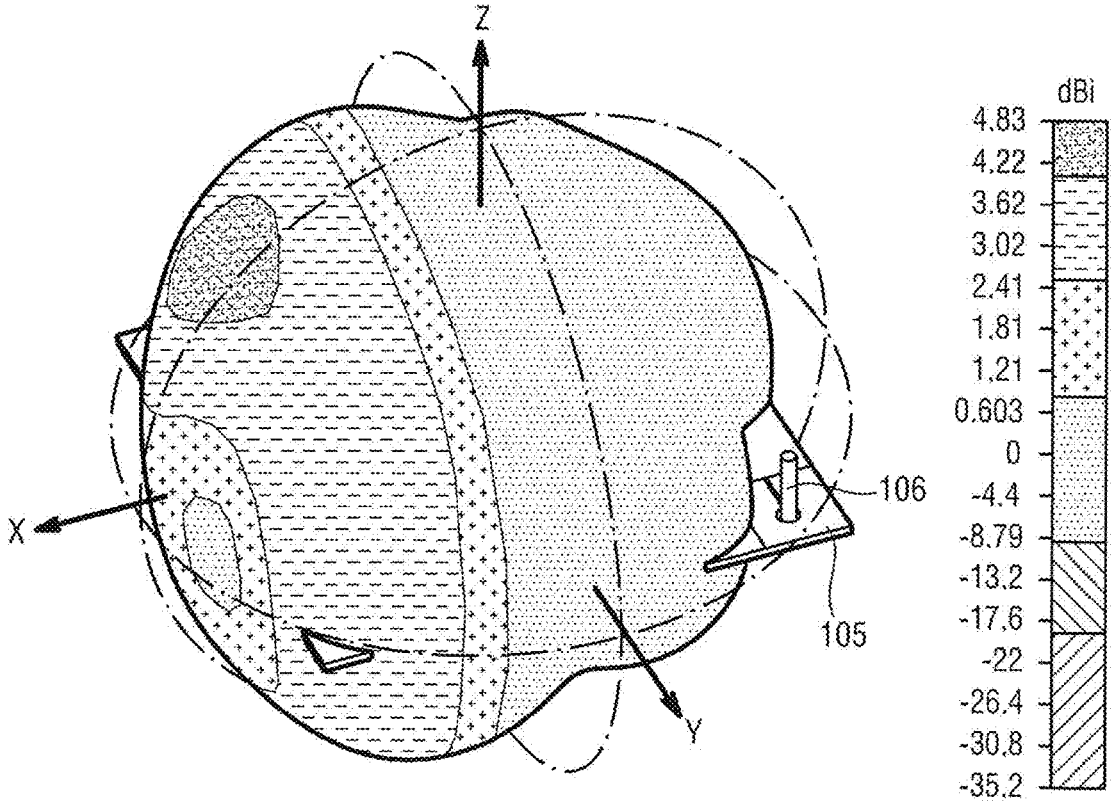
FIG. 15 shows a three-dimensional radiation pattern for an antenna of the RF transmit/receive device in the second embodiment of the invention.
Figure 16:
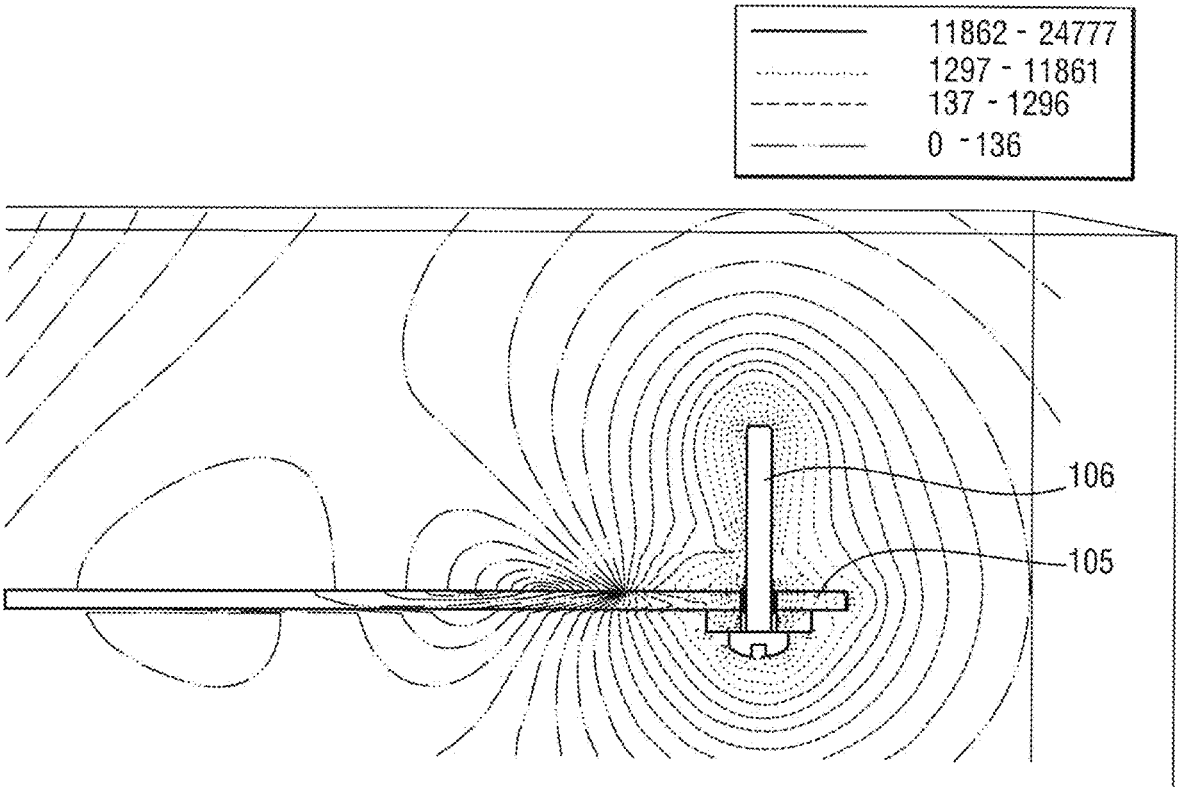
FIG. 16 represents the electric field around the screw.

With reference to FIGS. 15 and 16, it can be seen that for the antenna formed by the screw 106, by the first antenna track 121, and by the second antenna track 122, the effectiveness obtained at a frequency of 2.45 GHz is about −1.2 dB.

Figure 17:
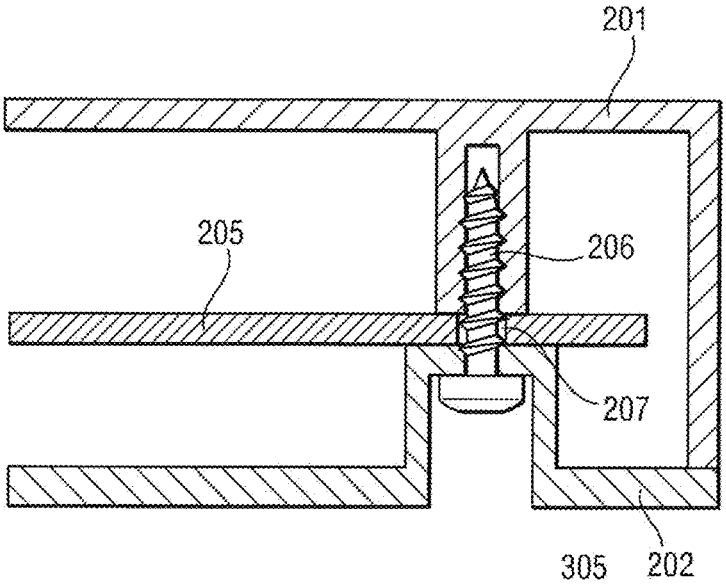
FIG. 17 shows an RF transmit/receive device in a third embodiment of the invention.

With reference to FIG. 17, it can be seen that the circuit card 205 of an RF transmit/receive device in a third embodiment of the invention may be positioned between a first support 201 and a second support 202. The screw 106 clamps together the first support 201, the second support 202, and the circuit card 205. By way of example, the first support 201 and the second support 202 may be covers of a housing.

In this example, the screw 206 is not in contact with the circuit card 205, and electromagnetic transfer between one or more tracks of the circuit card 205 and the screw 206 needs to take place by contactless electric coupling. As mentioned above, the proximity between the metal-lined hole 207, which is connected to a track, and the screw 206 may be sufficient to provide effective electric coupling.

Figure 18:
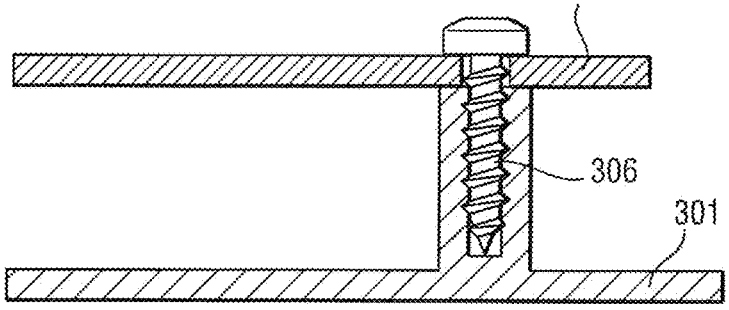
FIG. 18 shows an RF transmit/receive device in a fourth embodiment of the invention.

With reference to FIG. 18, it can be seen that the circuit card 305 of an RF transmit/receive device in a fourth embodiment of the invention may be fastened by means of the screw 306 on a single support 301. By way of example, the support 301 may be a base made of plastics material. Under such circumstances, there is a "mechanical" contact surface between the screw 306 and the circuit card 305. It is then possible to make provision for the contact surface to be positioned on a conductive layer of the circuit card 305 and to avoid varnishing the contact surface, such that the electric coupling between a track of the circuit card 305 and the screw 306 takes place by direct contact via the contact surface.

Whatever the fastener configuration used, account may be taken of the surroundings of the screw (presence or absence of a mass of plastics material, etc.) and of the electric coupling characteristics between the transmission-line track and/or the first antenna track and/or the second antenna track, in order to define accurately the characteristics of the antenna.

Naturally, the invention is not limited to the embodiments described, but covers any variant coming within the ambit of the invention as defined by the claims.

It is stated that the circuit cards are fastened to the various supports via screws made of iron, with one of the screws forming a radiating portion of the antenna. Naturally, other fastener elements could be used for fastening the circuit card on a support and for forming a radiating portion of the antenna, e.g. clips or staples. The fastener elements need not necessarily be made of iron, and they could be made out of any electrically conductive material. It is possible to use a different metal, e.g. copper, aluminum, steel, etc. A nonmetallic material could also be used, e.g. graphite. It is also possible to use a nonmetallic material filled with metal particles.

It is specified that the transmission line need not be a track, but by way of example it could be a conductor wire or a cable connecting the circuit card of the RF transmit/receive device to another circuit card of the electrical equipment.

The screw, or any other electrically conductive fastener element, could also act as a reflector element of a Yagi type antenna. The screw could also be used as an insulator between two antennas, and then form a dummy antenna. Under such circumstances, there is no signal to be conveyed to the radiating element, which is constituted by the screw alone performing the function of a whip antenna. The radiating whip may be connected or "rooted" in a ground plane.

The invention claimed is:

1. An RF transmit/receive device comprising a circuit card, a transmission line, and an electrically conductive fastener element for fastening the circuit card on a support, the transmission line being electrically coupled with the fastener element so that the fastener element forms at least a first radiating portion of an antenna arranged to transmit and/or to receive RF signals conveyed along the transmission line, the circuit card further comprising a first antenna track connected to the transmission line and electrically coupled with the fastener element, the first antenna track forming a second radiating portion of the antenna, wherein the transmission line extends on an insulating layer of the circuit card within a ground surface, whereas the first antenna track extends on the insulating layer without being surrounded by the ground surface.

2. The RF transmit/receive device according to claim 1, wherein the circuit card includes a first surface formed on a conductive layer and a second surface formed on an insulating layer, the first surface being the ground surface, the fastener element extending from or through the second surface.

3. The RF transmit/receive device according to claim 2, wherein the transmission line is a transmission-line track of the circuit card that extends from within the first surface to the second surface in order to form the first antenna track that extends within the second surface to the proximity of the fastener element.

4. The RF transmit/receive device according to claim 3, wherein the antenna is a monopole antenna.

5. The RF transmit/receive device according to claim 2, wherein the circuit card includes a second antenna track that extends within the second surface, that is connected to the first antenna track, and that forms a third radiating portion of the antenna.

6. The RF transmit/receive device according to claim 5, wherein the antenna is a planar inverted-F antenna.

7. The RF transmit/receive device according to claim 1, a resonant frequency of the antenna being defined in particular on the basis of a length of the fastener element.

8. The RF transmit/receive device according to claim 7, wherein the resonant frequency of the antenna is also defined on the basis of a length of the first antenna track and/or of a length of the second antenna track, and thus of at least one dimension of the second surface.

9. The RF transmit/receive device according to claim 1, wherein the fastener element extends through a metal-lined hole-formed in the circuit card, the first antenna track or the second antenna track being connected to the metal-lined hole.

10. The RF transmit/receive device according to claim 1, wherein the antenna is a Yagi type antenna, and wherein the fastener element acts as a reflector element of the Yagi antenna.

11. The RF transmit/receive device according to claim 1, wherein the fastener element is a screw.

12. Electrical equipment including the RF transmit/receive device according to claim 1.

13. The electrical equipment according to claim 12, the support of the circuit card being a housing of the electrical equipment.

* * * * *